US007918766B2

(12) United States Patent
Lu et al.

(10) Patent No.: US 7,918,766 B2
(45) Date of Patent: Apr. 5, 2011

(54) ELLIPTICAL MECHANISM

(75) Inventors: Zhi Lu, Wet Dundee, IL (US); John M. Rogus, Skokie, IL (US); Eric White, Elgin, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/729,269

(22) Filed: Mar. 28, 2007

(65) Prior Publication Data

US 2008/0242516 A1 Oct. 2, 2008

(51) Int. Cl.
*A63B 22/04* (2006.01)

(52) U.S. Cl. ..... 482/52; 482/51; 482/57

(58) Field of Classification Search ..... 482/51, 482/52, 53, 57, 63, 70, 71, 79, 80
See application file for complete search history.

(56) References Cited

U.S. PATENT DOCUMENTS

| | | | | |
|---|---|---|---|---|
| 3,316,898 | A | 5/1967 | Brown | |
| 5,242,343 | A | 9/1993 | Miller | 482/57 |
| 5,383,829 | A | 1/1995 | Miller | 482/57 |
| 5,419,751 | A * | 5/1995 | Byrd et al. | 482/138 |
| 5,499,956 | A | 3/1996 | Habing et al. | 482/52 |
| 5,685,804 | A | 11/1997 | Whan-Tong et al. | 482/51 |
| 5,759,136 | A | 6/1998 | Chen | 482/57 |
| 5,762,588 | A | 6/1998 | Chen | 482/57 |
| 5,779,599 | A | 7/1998 | Chen | 482/57 |
| 5,792,026 | A | 8/1998 | Maresh et al. | 482/51 |
| 5,893,820 | A * | 4/1999 | Maresh et al. | 482/51 |
| 5,895,339 | A * | 4/1999 | Maresh | 482/51 |
| 5,899,833 | A | 5/1999 | Ryan et al. | 482/52 |
| 6,042,512 | A * | 3/2000 | Eschenbach | 482/52 |
| 6,045,488 | A * | 4/2000 | Eschenbach | 482/52 |
| 6,077,198 | A * | 6/2000 | Eschenbach | 482/52 |
| 6,080,086 | A * | 6/2000 | Maresh et al. | 482/57 |
| 6,099,439 | A | 8/2000 | Ryan et al. | 482/51 |
| 6,176,814 | B1 | 1/2001 | Ryan et al. | 482/51 |
| 6,217,485 | B1 * | 4/2001 | Maresh | 482/52 |
| 6,217,486 | B1 | 4/2001 | Rosenow et al. | 482/52 |
| 6,248,045 | B1 * | 6/2001 | Stearns et al. | 482/52 |
| 6,312,362 | B1 * | 11/2001 | Maresh et al. | 482/52 |
| 6,361,476 | B1 * | 3/2002 | Eschenbach | 482/52 |
| 6,540,646 | B2 * | 4/2003 | Stearns et al. | 482/52 |
| 6,544,146 | B1 * | 4/2003 | Stearns et al. | 482/52 |
| 6,554,750 | B2 * | 4/2003 | Stearns et al. | 482/57 |
| 6,569,061 | B2 * | 5/2003 | Stearns et al. | 482/52 |
| 6,620,079 | B2 * | 9/2003 | Kuo | 482/51 |
| 6,645,125 | B1 * | 11/2003 | Stearns et al. | 482/52 |
| 6,672,992 | B1 * | 1/2004 | Lo et al. | 482/52 |
| 6,726,600 | B2 * | 4/2004 | Miller | 482/51 |
| 6,846,272 | B2 | 1/2005 | Rosenow et al. | 482/52 |
| 6,991,587 | B1 * | 1/2006 | Eschenbach | 482/52 |
| 7,025,711 | B2 * | 4/2006 | Eschenbach | 482/52 |
| 7,033,305 | B1 * | 4/2006 | Stearns et al. | 482/52 |
| 7,052,438 | B2 * | 5/2006 | Eschenbach | 482/52 |
| 7,101,316 | B2 * | 9/2006 | Rosenow et al. | 482/52 |

(Continued)

*Primary Examiner* — Loan Thanh
*Assistant Examiner* — Daniel F Roland
(74) *Attorney, Agent, or Firm* — Michael B. McMuary

(57) ABSTRACT

Described is an exercise apparatus for providing elliptical foot motion that utilizes a pair of rocking links suspended from an upper portion of the apparatus frame permitting at least limited arcuate motion of the lower portions of the links. Foot pedal assemblies are connected to rotating shafts or members located on the lower portion of the links such that the foot pedals will describe a generally elliptical path in response to user foot motion on the pedals.

5 Claims, 6 Drawing Sheets

U.S. PATENT DOCUMENTS

| | | | | |
|---|---|---|---|---|
| 7,169,090 | B1 | 1/2007 | Maresh | 482/52 |
| 7,455,624 | B2 * | 11/2008 | Liao Lai | 482/52 |
| 2002/0032104 | A1 * | 3/2002 | Rosenow et al. | 482/52 |
| 2002/0077220 | A1 * | 6/2002 | Kuo | 482/51 |
| 2002/0094914 | A1 * | 7/2002 | Maresh et al. | 482/51 |
| 2002/0119867 | A1 * | 8/2002 | Stearns et al. | 482/52 |
| 2002/0142890 | A1 | 10/2002 | Ohrt et al. | 482/52 |
| 2002/0198084 | A1 * | 12/2002 | Stearns et al. | 482/57 |
| 2003/0027690 | A1 * | 2/2003 | Miller | 482/51 |
| 2004/0209741 | A1 * | 10/2004 | Kuo | 482/52 |
| 2005/0043148 | A1 * | 2/2005 | Maresh | 482/70 |
| 2005/0049118 | A1 * | 3/2005 | Rosenow et al. | 482/52 |
| 2005/0085344 | A1 * | 4/2005 | Eschenbach | 482/51 |
| 2005/0164837 | A1 | 7/2005 | Anderson et al. | 482/52 |
| 2005/0209056 | A1 * | 9/2005 | Daly et al. | 482/52 |
| 2005/0245361 | A1 * | 11/2005 | Wu et al. | 482/57 |
| 2006/0189446 | A1 * | 8/2006 | Rogus | 482/52 |
| 2006/0247103 | A1 * | 11/2006 | Stearns et al. | 482/52 |
| 2007/0032350 | A1 * | 2/2007 | Alessandri et al. | 482/52 |
| 2007/0037666 | A1 * | 2/2007 | Gagnon et al. | 482/51 |
| 2007/0087903 | A1 * | 4/2007 | Lee et al. | 482/52 |
| 2007/0179023 | A1 * | 8/2007 | Dyer | 482/52 |
| 2007/0298936 | A1 * | 12/2007 | Ohrt et al. | 482/52 |
| 2008/0051258 | A1 * | 2/2008 | Schmehl et al. | 482/52 |

* cited by examiner

ELLIPTICAL MECHANISM

FIELD OF THE DESCRIBED APPARATUS

The described apparatus relates generally to exercise equipment and, more particularly, to exercise equipment which can be used to provide a user with an elliptical step exercise.

BACKGROUND OF THE DESCRIBED APPARATUS

There are a number of different types of exercise apparatuses that exercise a user's lower body by providing a generally elliptical stepping motion. These elliptical stepping apparatuses provide advantages over other types of exercise apparatuses. For example, the elliptical stepping motion generally reduces shock on the user's knees as can occur when a treadmill is used. In addition, elliptical stepping apparatuses tend to produce a more natural foot motion than certain other types of exercise equipment. Examples of elliptical stepping apparatuses include U.S. Pat. Nos. 3,316,898; 5,242,343; 5,383,829; 5,499,956; 5,685,804; 5,759,136; 5,762,588; 5,779,599; 5,792,026; 5,899,833, 6,099,439, 6176,814, 6,217,486 and 6,846,272 along with U.S. Patent Application Publication No. 20050164837.

However, known elliptical stepping exercise apparatuses suffer from various drawbacks. As an example, most elliptical machines use at least one crank rotating about an axel fixed to the machine's frame, as exemplified by the various apparatus described in the above identified documents. As a result, either the elliptical machines do not closely correspond to a natural walking or running foot motion or elaborate mechanisms are used to compensate for the constraints of a fixed axel crank arrangement.

SUMMARY OF THE DESCRIPTION

It is therefore one object of the described mechanism to provide an elliptical stepping exercise apparatus having pedals that can more closely simulate natural foot motion.

DETAILED DESCRIPTION OF THE PREFERRED EMBODIMENTS

Figure 1:
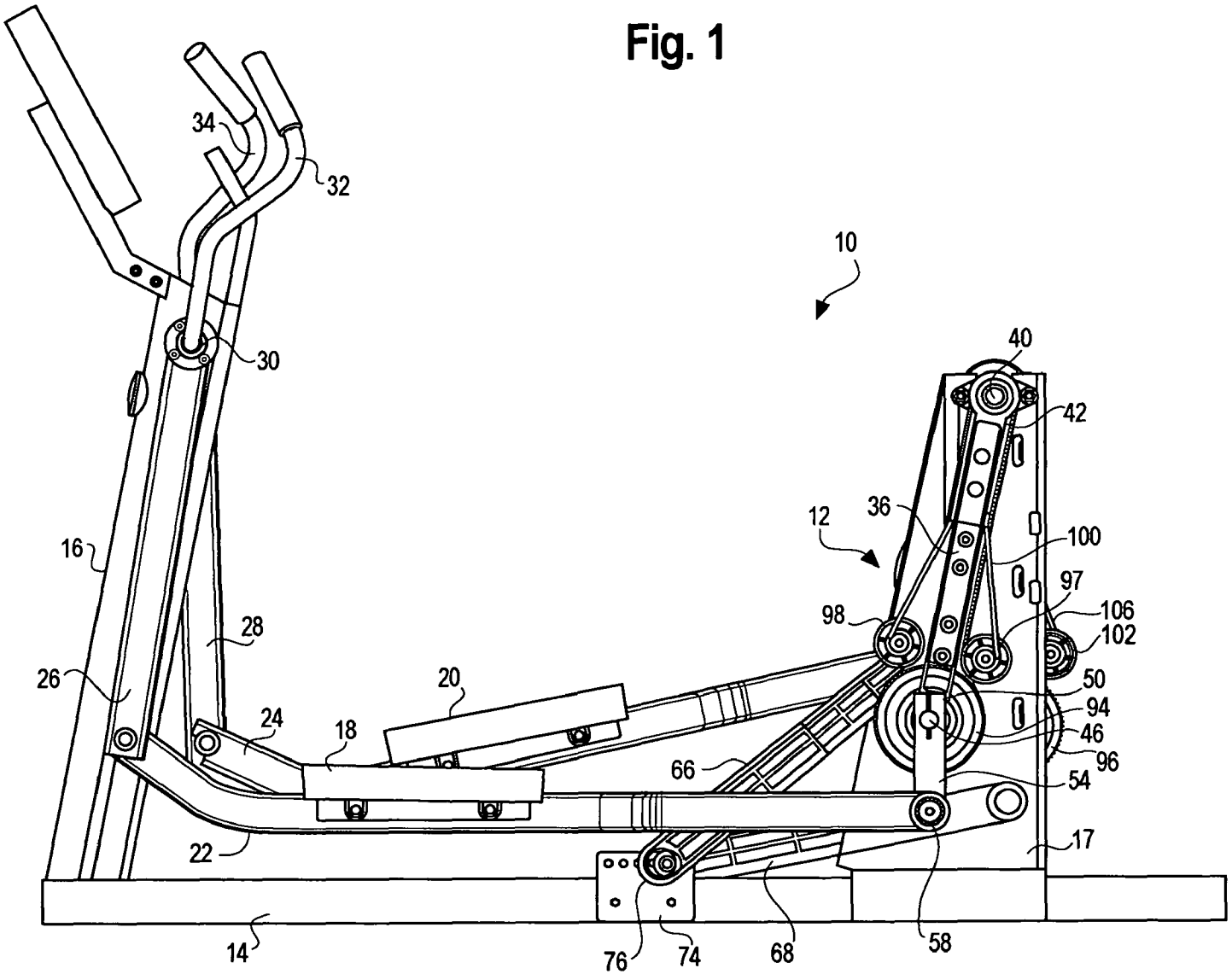
FIG. 1 is a side view of the left hand portion of an elliptical step apparatus mechanism illustrating a first embodiment of the described mechanism.

FIG. 1 is an example of an elliptical step apparatus 10, which provides an illustrative environment for describing a first and preferred embodiment, indicated generally at 12, of a rocker mechanism for generating an elliptical foot motion. In this case, the elliptical step apparatus 10 includes a frame 14 having a forward vertical support member 16 and a rear vertical support member 17. A pair of pedals 18 and 20 are fixed to and supported by a pair of pedal levers 22 and 24 that are in turn pivotally attached to a pair of arm handle rocker members 26 and 28 in this particular embodiment of the apparatus 10. Here, the arm handle rockers 26 and 28 are also attached to a pivot point indicated at 30 on the vertical support member 16 and as a result provide support for the forward ends of the pedal levers 22 and 24 and allow for a generally horizontal, reciprocating motion of the forward ends of the pedal levers 22 and 24. It will be appreciated, however that other methods can be used to support the forward ends of the pedal levers 22 and 24 for substantially horizontal movement including using rollers engaged with tracks mounted on the frame 14. The arrangement of FIG. 1 has the advantage that a pair of arm handles 32 and 34 can be attached to the rockers 26 and 28 at the pivot point 30 such that the handles 32 and 34 move with the pedals 18 and 20.

Figure 2:
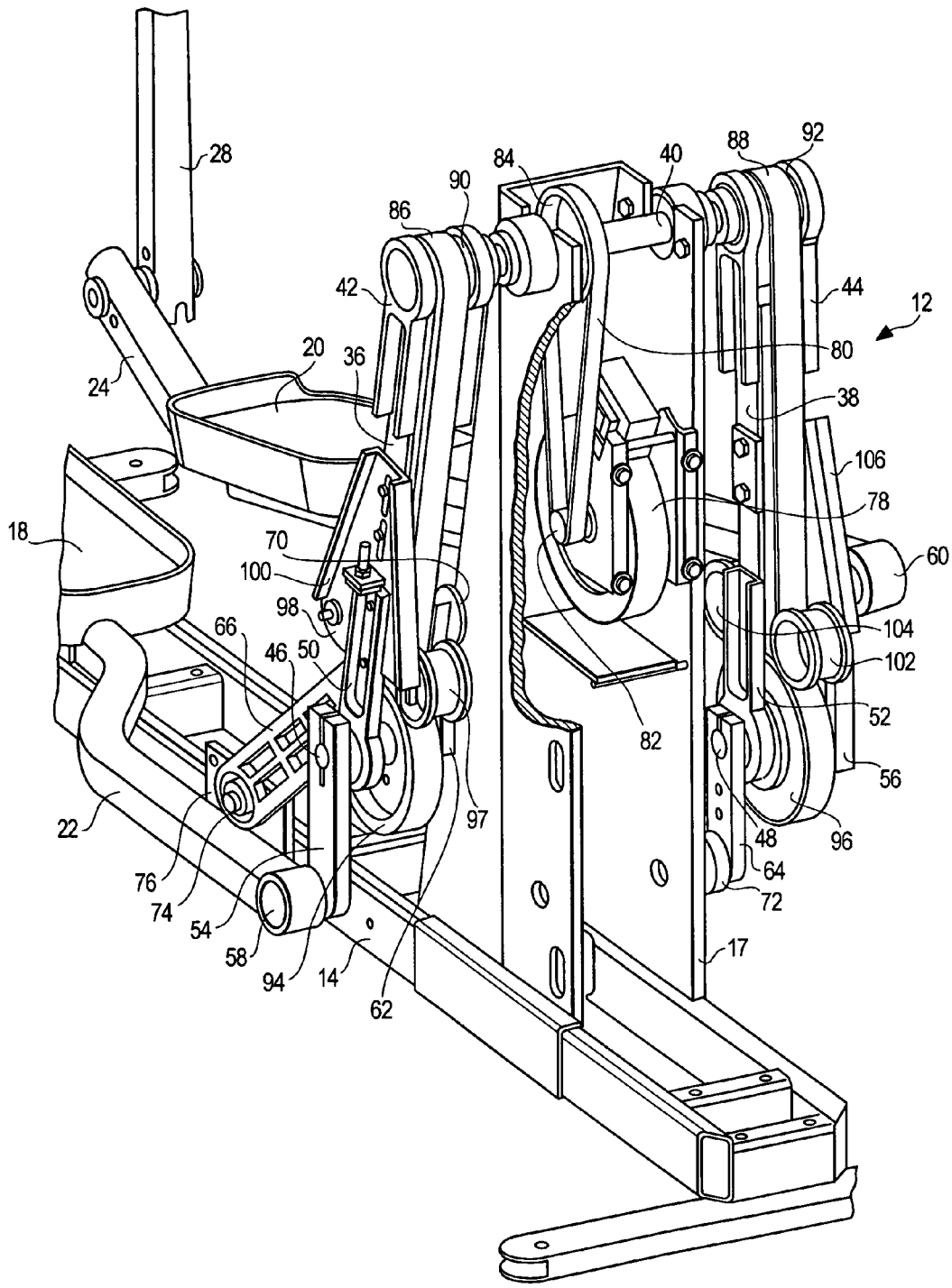
FIG. 2 provides an expanded and partially sectioned, rear perspective view of the mechanism of FIG. 1.

As shown in FIG. 1 and in more detail and in perspective in FIG. 2, the embodiment of the mechanism 12 includes a pair of rocking links 36 and 38 that are rotatably attached at their upper ends to an upper shaft 40 by a set of bearing mounts indicated at 42 and 44. In this embodiment, the upper shaft 40 is mounted on the vertical support structure or member 17 such that the lower ends of the rocking links 36 and 38 can have at least a limited arcuate motion. In the preferred embodiment, the shaft 40 is mounted, for example by a set of bearings, on the member 17 such that it can also rotate. Also included in the mechanism 12, are a pair of rocking link shafts 46 and 48 that are secured in the lower ends of the rocking links 36 and 38 by another set of bearing mounts indicated at 50 and 52. The bearing mounts 50 and 52 permit the rocking link shafts to rotate on the lower ends of the rocking links. Each of the rocking link shafts 46 and 48 has attached to it for rotation an outer crank arm 54 and 56 respectively. The ends of the outer cranks 54 and 56 are then pivotally connected at a hub 58 and 60 to the pedal links 22 and 24 thereby serving as a connection assembly of the pedal levers 22 and 24 to the rotating rocking link shafts 46 and 48. Also attached for rotation to the rocking link shafts 46 and 48 are a pair of inner crank arms 62 and 64. In this embodiment, the ends of the inner cranks 62 and 64 are pivotally attached to one end of a pair of rocker members 66 and 68 via a pair of hubs 70 and 72. The rocker members 66 and 68 are then pivotally attached to the frame 14 by a pair of bearings, as generally indicated at 74, that in turn are secured to the frame 14 by a pair of mounting plates, generally indicated at 76.

Figure 3A:
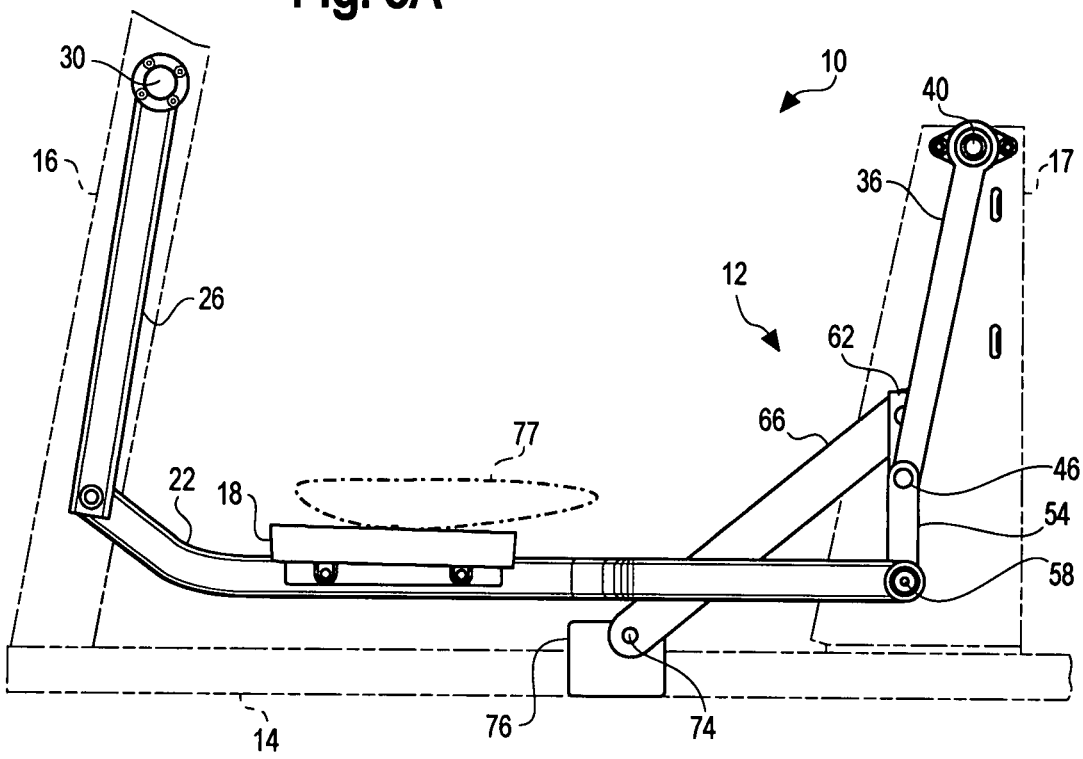
FIGS. 3A, 3B, 3C and 3D are schematic views illustrating the operation of the mechanism of FIG. 1.
Figure 3B:
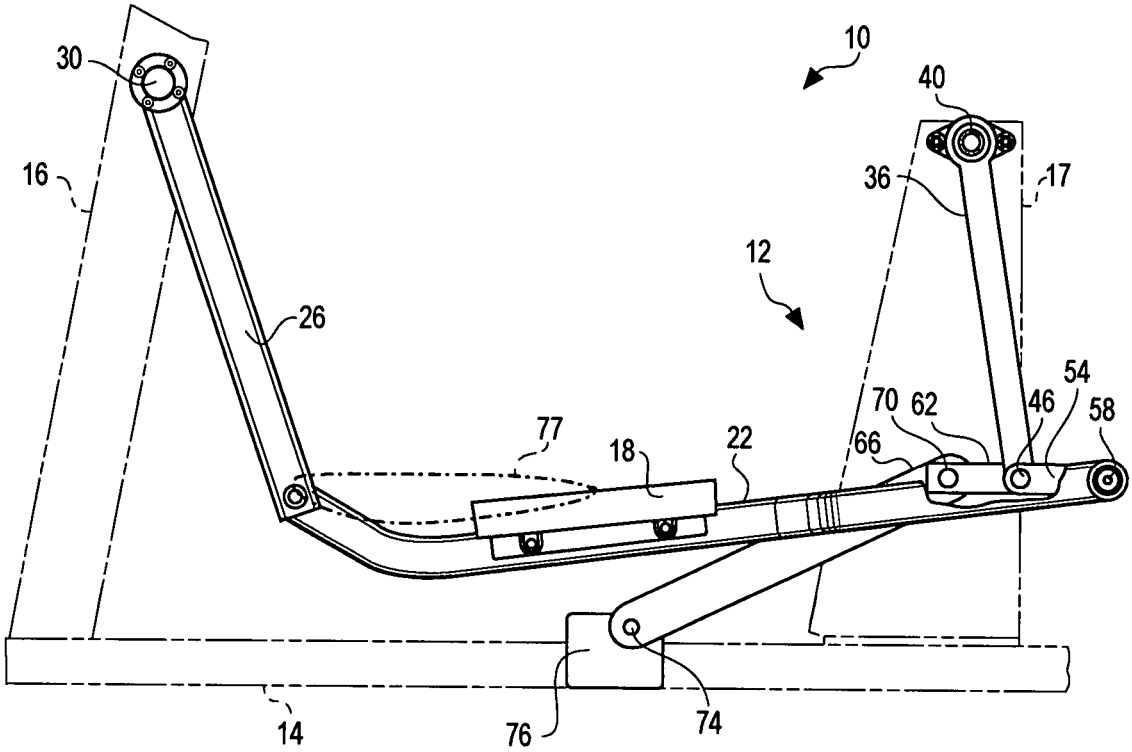
Figure 3C:
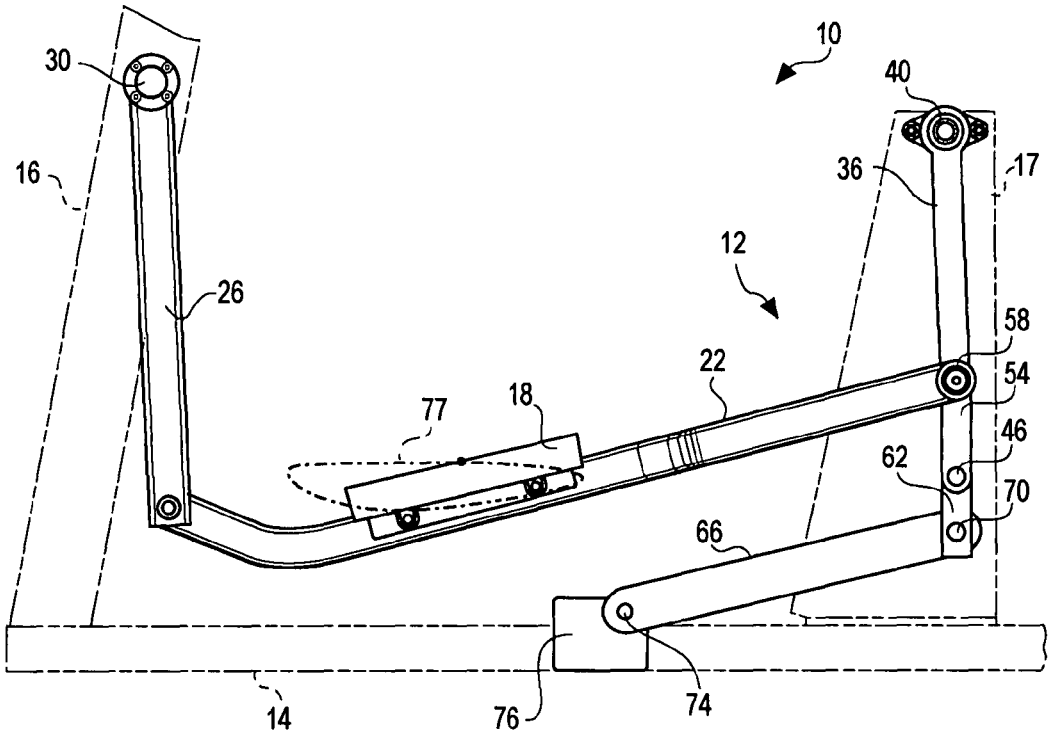
Figure 3D:
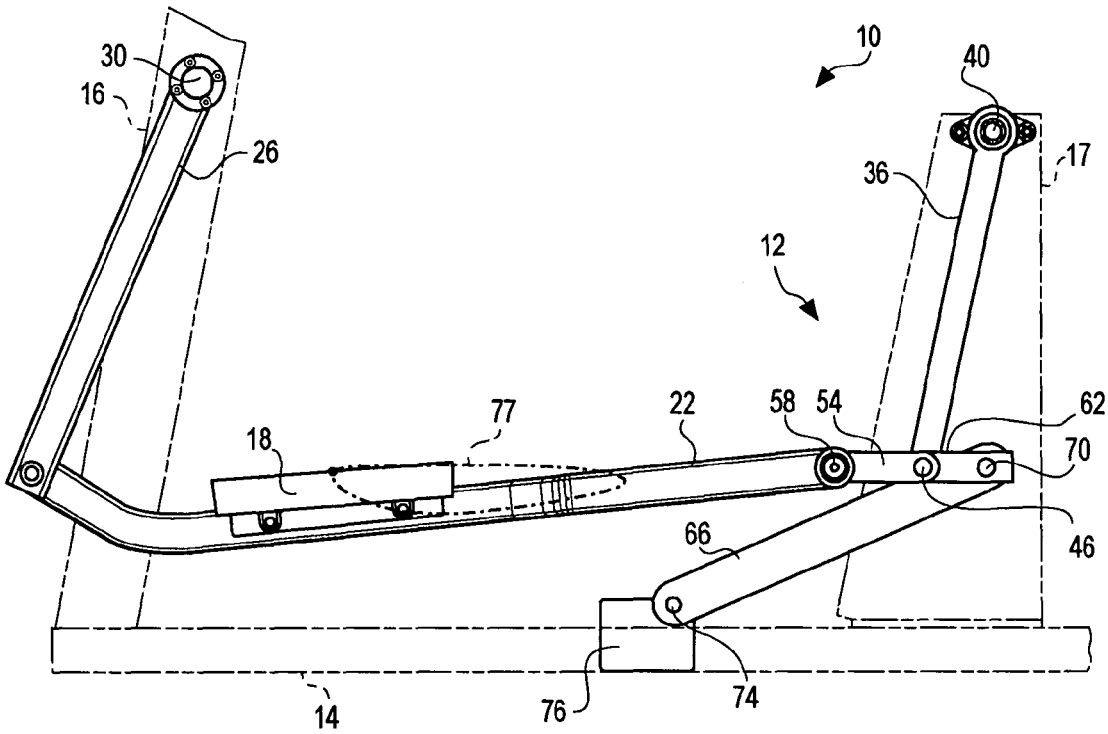

FIGS. 3A-3D illustrate the operation of the rocker mechanism 12. These figures depict in schematic form the basic elements of left hand portion of the mechanism 12. First, the combination of rotation of the inner crank 62 with the rocker 66 will result in the rocking link 36 rotating about the upper shaft 40 producing a limited arcuate motion of the rocking link shaft 46 located on the lower end of the rocking link 36. When the inner crank 62 is in the 360 degree position, as shown in FIG. 3A, the rocking link 36 will be substantially, vertical; when the inner crank 62 is in the 270 degree position as shown in FIG. 3B, the rocking link 36 will be rotated to almost its rear most position; when the inner crank 62 is in the 180 degree position as shown in FIG. 3C, the rocking link 36 will be again be substantially vertical; and when the inner crank 62 is in the 90 degree position as shown in FIG. 3D, the rocking link 36 will be rotated to almost its forward most position. This action will cause the rearward end of the pedal lever 22 at hub 58 to reciprocate in an essentially horizontal direction. At the same time, as shown in FIGS. 3A-3D, rotation of the outer crank arm 58 which connected to the hub 58 will cause the reward end of the pedal lever 22 to essentially reciprocate vertically. As a result of these combinations of movements, the reward end of the pedal lever 22 at the hub 58 will trace an essentially elliptical path as the rocking link shaft 46 rotates and consequentially in the pedal 18 will also move in an essentially elliptical path indicated by a dashed line 77. It will be appreciated, that the dimensions of the various elements shown in FIGS. 3A-D can be varied to adjust the shape as well as the horizontal and vertical extent of the ellipse traced by the pedal 22. Additionally, the angular relation between the inner crank 62 and the pedal crank 54, which in the preferred embodiment is 180 degrees, can be varied to further modify the path of the foot pedal 18.

FIGS. 1 and 2 also illustrate the preferred embodiment of a resistance mechanism 78 for use with the apparatus 10. In this embodiment the resistance mechanism 78 preferably includes a flywheel generator assembly. However, other types of resistance devices can be used such as an alternator, eddy current brakes or various mechanical and hydraulic devices. Also, in the preferred embodiment, the resistance mechanism 78 is connected to the rocking link shafts 46 and 48 by a belt 80 that serves to connect a pulley 82 mounted on the shaft of the flywheel generator assembly 78 to another pulley 84 secured for rotation on the upper shaft 40. Then, the shaft 40 is connected for rotation with the rocking link shafts 46 and 48 by a pair of belts 86 and 88 that serve to connect a pair of pulleys 90 and 92 mounted for rotation with the upper shaft 40 with a pair of pulleys 94 and 96 that are mounted for rotation with rocking link shafts 46 and 48. Under some circumstances it might be desirable to provide aid in maintaining engagement of the belt 86 with the pulleys 90 and 94. For example, a pair of idler pulleys 97 and 98 can be rotatably attached to a tensioner bracket 100 that in turn is secured to the rocking link 36. Similarly, to aid in maintaining engagement of the belt 88 with the pulleys 92 and 96, another pair of idler pulleys 102 and 104 can be rotatably attached to a tensioner bracket 106 secured to the rocking link 38. Thus, in this embodiment, the resistive force generated by the resistance device 78 can be transmitted to the pedals 18 and 20. It should also be noted that in this embodiment, the belts 86 and 88 in combination with the shaft 40 serve to effectively couple the left pedal 18 for operation with the right pedal 22.

Figure 4:
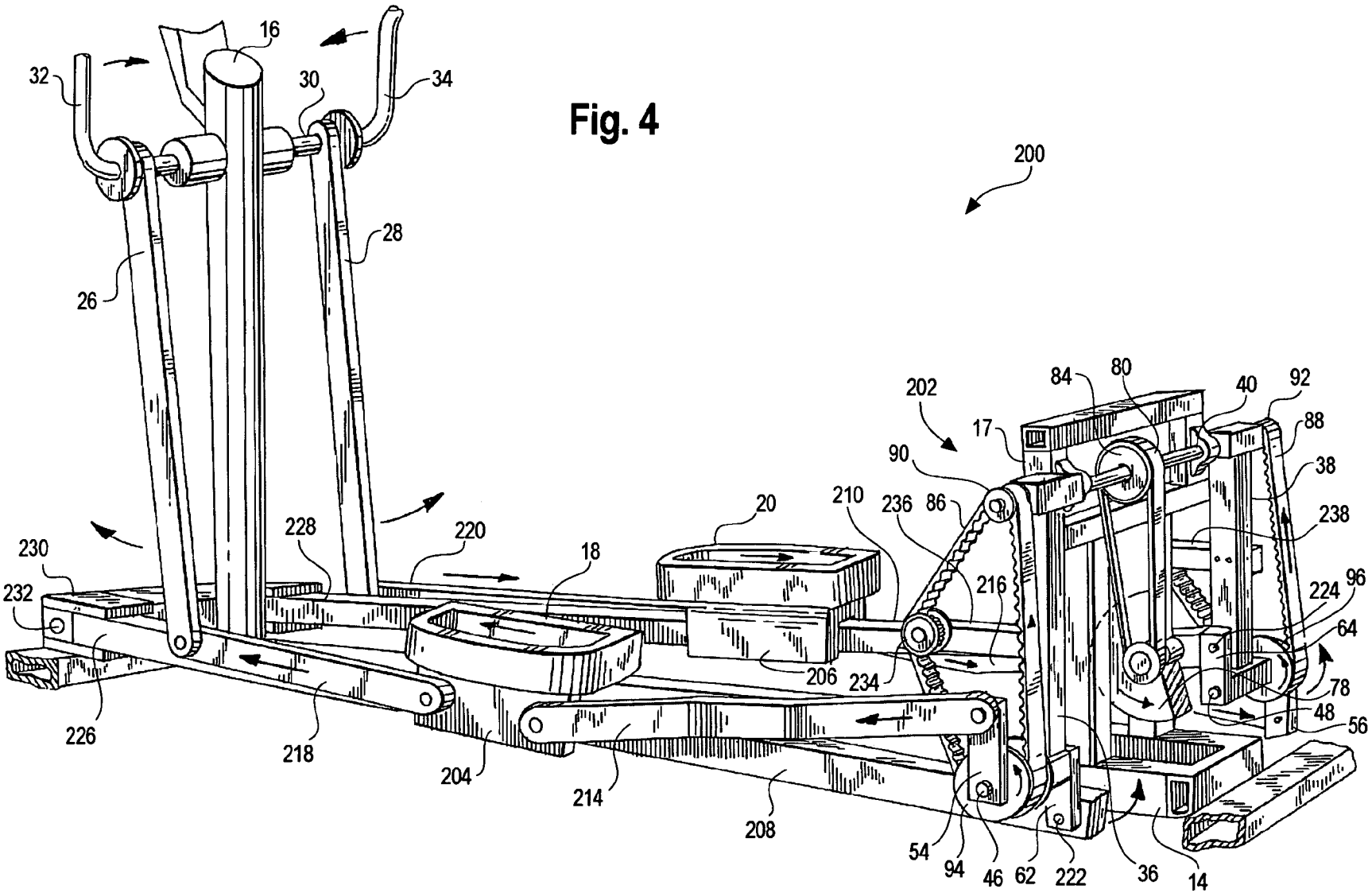
FIG. 4 is a left perspective view illustrating a second embodiment of the described mechanism.

FIG. 4 depicts another example of an elliptical step apparatus 200, which includes a second embodiment, indicated generally at 202, of a rocker mechanism for generating an elliptical foot motion. For simplicity of description, those elements of the apparatus 200 that generally correspond to the elements of the apparatus 10 are identified by the same reference numerals. The apparatus 200 differs from the apparatus 10 of FIGS. 1 and 2 in a number of respects. First, the pedals 18 and 20 are shown as secured to a pair of U-shaped pedal support members 204 and 206 that are configured to permit the members 204 and 206 to move longitudinally along a pair of pedal lever 208 and 210 respectively. Various mechanical methods including roller assemblies can be used to support the pedals 18 and 22 on the pedal levers 208 and 210 while allowing them to move along the pedal levers 18 and 22. A pair of stroke links 212 and 214 are pivotally connected between the pedal support members 204 and 206 and the outer crank arms 54 and 56. Similarly, a pair of links 218 and 220 is pivotally connected between the pedal support members 204 and 206 and the rocker members 26 and 28. The pedal levers 208 and 210 are pivotally connected to the inner crank arms 62 and 64 at a pair of pivot points 222 and 224 at one end and are preferably secured at the other end, indicated generally at 226 and 228, within a receptacle 230. To permit limited angular rotation of the pedal levers 208 and 210, the receptacle 230 itself can be pivotally secured to the frame 14 as represented by a pivot 232. As a result the receptacle 230 will permit angular motion of the pedal levers 208 and 210 about the pivot point 232. In this embodiment, the pedal levers 208 and 210 will also have the effect of causing the angular rotation of the rocking links 36 and 38 as the inner crank arms 62 and 64 rotate on the shafts 46 and 48. As with the apparatus 10, a resistance device such as the flywheel generator assembly 78 can be connected to the shafts 46 and 48 using a mechanical arrangement represented by the belts 80, 86, and 88 and the pulleys 84, 90, 92, 94 and 96. In this case, a pair of idler pulleys, represented by 234, which are pivotally mounted on a pair of support members 236 and 238, can function as belt tensioners.

Figure 5A:
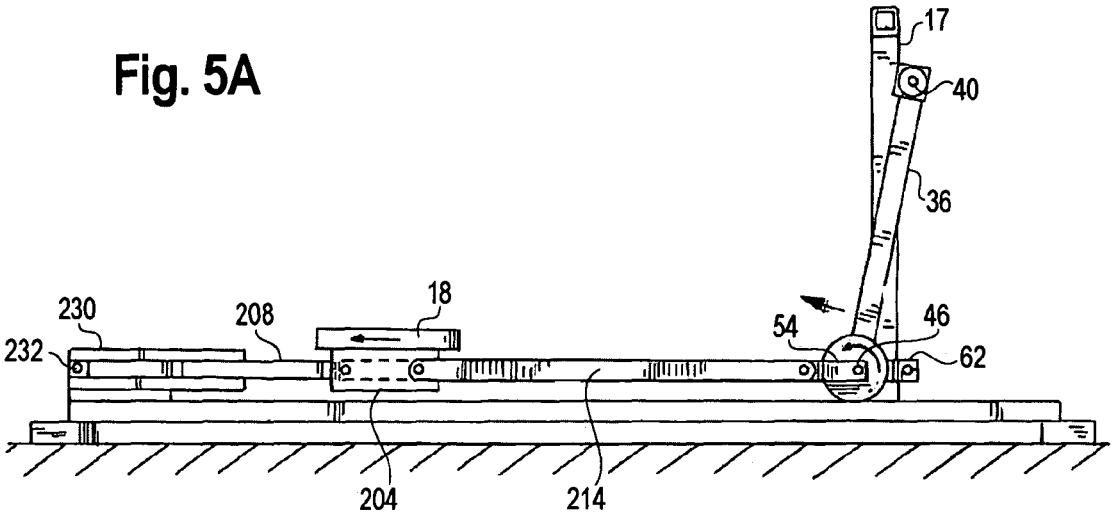
FIGS. 5A, 5B, 5C and 5D are schematic views illustrating the operation of the mechanism of FIG. 4.
Figure 5B:
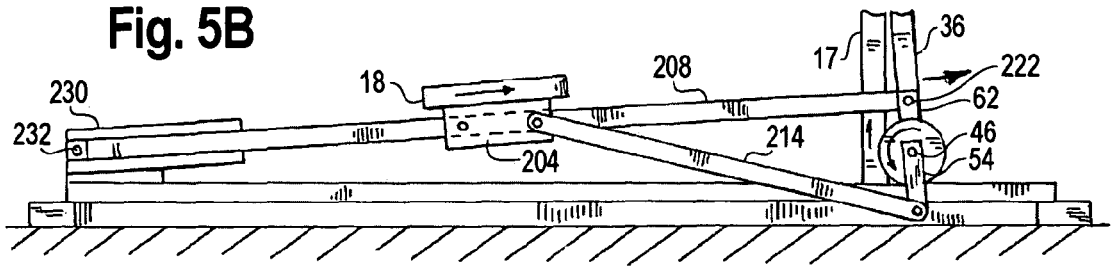
Figure 5C:
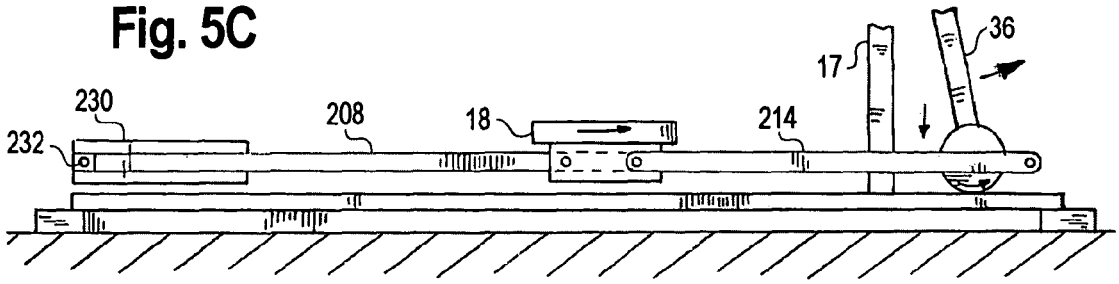
Figure 5D:
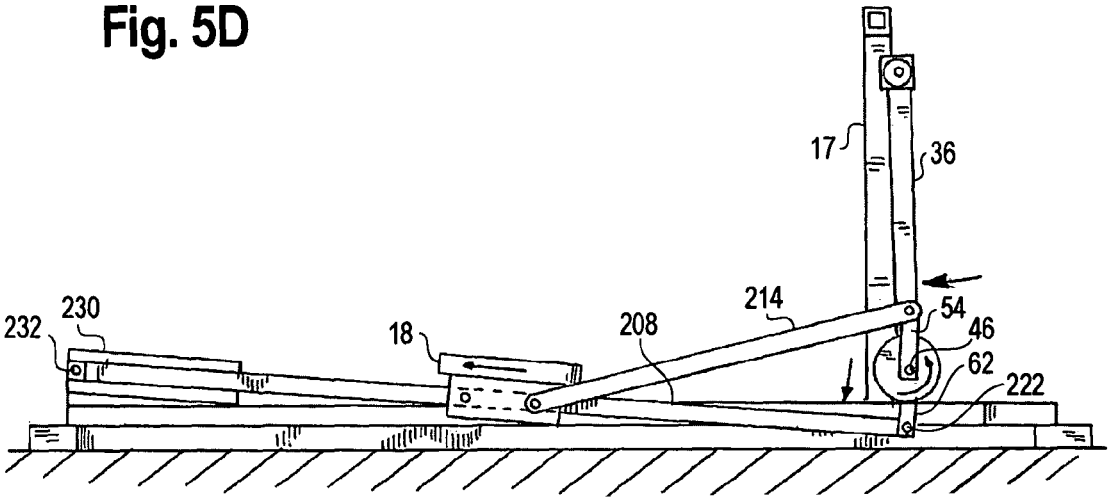

FIGS. 5A-5D illustrate in schematic form the operation of the rocker mechanism 202 using the basic elements of left hand portion of the rocker mechanism 202. Here, the rotation of the inner crank 62 will result in the end of the pedal lever 208 at pivot point 222 to rotate about the shaft 46. At the same time, movement of users foot on pedal 18 transmitted on the stroke link 214 and the outer crank 54 will cause the shaft 46 to rotate. The combination of the motion of both the pedal 18 along the pedal lever 208 and the substantially vertical reciprocating motion of the end of the pedal lever 208 at pivot point 222 will result in the limited arcuate motion of the shaft 46 located on the lower end of the rocking link 36. When the inner crank 62 is in the 90 degree position, as shown in FIG. 5A, the rocking link 36 will be rotated to almost its forward most position; when the inner crank 62 is in the 360 degree position as shown in FIG. 5B, the rocking link 36 will be rotated to a substantially vertical position; when the inner crank 62 is in the 180 degree position as shown in FIG. 3C, the rocking link 36 will be again be rotated to almost its forward most position; and when the inner crank 62 is in the 180 degree position as shown in FIG. 3D, the rocking link 36 will again be substantially vertical. This will result in the in the reward end of the pedal lever at pivot point 222 tracing an essentially elliptical path as the rocking link shaft 46 rotates and as a result the pedal 18 will also move in an essentially elliptical path. It will be appreciated, that the dimensions of the various elements shown in FIGS. 5A-D can be varied to adjust the shape as well as the horizontal and vertical extent of the ellipse traced by the pedal 18. Additionally and as with the apparatus 10, the angular relation between the inner crank 62 and the pedal crank 54, which is shown at 180 degrees, can be varied to further modify the path of the foot pedal 18.

It will be appreciated that the above description and depictions of the apparatus 10 and 200 represent the preferred embodiments of two different approaches to a mechanism for generating elliptical foot motion utilizing a rocking link of the type 36 and 38. For example, other assemblies for connecting a rocking link type member to foot pedals or foot pedal assemblies can be used that would for example use a rotating cam arrangement instead of the crank arms 54, 56, 62 and 64. As another example, the preferred embodiments have the elliptical generating portion of the mechanism at the rear of the apparatus as shown in the figures. However, there can be instances where it would be desirable to place this portion of the mechanism at the front of the apparatus. Moreover, it should be appreciated that certain terms such as "rocking link", "pedal lever", "crank arms" and stroke link" have been used to facilitate understanding of the construction and operation of the described embodiments and are not intended to limit the components described to any particular mechanical element or mechanism.

We claim:

1. An exercise apparatus for providing an elliptical foot motion comprising:

a frame including a substantially vertical support structure at a first end;

a first and a second rocking link each pivotally connected at a first end to an upper portion of said vertical support structure;

a first and a second rotational member including a shaft wherein said shafts are rotatably secured for 360 degree rotation directly to a second end of said first and second rocking links respectively;

a first and a second pedal assembly each including a pedal and a pedal lever; and a first and a second connection assembly each including a first crank supported by and secured to said shaft for rotation with said shaft and connected to said pedal lever for connecting a first end of said first and second pedal assemblies to said first and second shafts respectively and a second crank secured to said shafts for rotation with said shafts on the same pivot axis as said first crank and secured to said frame effective to cause arcuate movement of said second ends of said rocking links such that the combination of rotation of said shafts with an arcuate movement of said second ends of said rocking links will result in a substantially elliptical movement of said pedals.

2. The apparatus of claim 1 wherein said connection assemblies each include a rocker member pivotally connected to said frame and to said second crank effective to cause said arcuate movement of said second ends of said rocking link.

3. The apparatus of claim 1 further including:

a resistance mechanism rotationally secured to said vertical support structure and operatively connected to said rotational members;

an upper shaft mounted to an upper portion of said vertical support structure and wherein said connection of said first ends of said first and second rocking links includes pivotally mounting said first ends to said upper shaft;

a first and a second flexible member operatively connecting said first and second rotational members respectively to said upper shaft and wherein said upper shaft is operatively connected to said resistance mechanism;

wherein said first and said second rotational members each include a lower pulley mounted for rotation with said lower shaft and further including a pair of upper pulleys mounted for rotation with said upper shaft, each associated with one of said lower pulleys, and wherein said first and second flexible members are engaged with said upper and lower pulleys; and a third flexible member connecting said upper shaft to said resistance mechanism.

4. The apparatus of claim 1 wherein said frame includes a rocker support member at a second end of said frame and including a first and a second rocker pivotally secured to said rocker support member and pivotally secured to a second end of said first and second pedal assemblies respectively.

5. An exercise apparatus for providing an elliptical foot motion comprising:

a frame including a substantially vertical support structure at a first end;

a first and a second rocking link each pivotally connected at a first end to an upper portion of said vertical support structure;

a first and a second rotational member rotatably secured to a second end of said first and second rocking links respectively;

a first and a second pedal assembly each including a pedal and a pedal lever;

a first and a second connection assembly each including a first crank secured to said rotational member for rotation with said rotational member and connected to said pedal lever for connecting a first end of said first and second pedal assemblies to said first and second rotational members respectively and a second crank secured to said rotational member for rotation with said rotational member on the same pivot axis as said first crank and to said frame effective to cause arcuate movement of said second ends of said rocking links such that the combination of rotation of said rotational members with an arcuate movement of said second ends of said rocking links will result in a substantially elliptical movement of said pedals;

wherein each of said first and second rotational members includes a lower shaft to which said first crank is secured wherein said lower shaft is rotatably secured to said first and second rocking links respectively and further including:

a resistance mechanism rotationally secured to said vertical support structure and operatively connected to said rotational members;

an upper shaft mounted to an upper portion of said vertical support structure and wherein said connection of said first ends of said first and second rocking links includes pivotally mounting said first ends to said upper shaft;

a first and a second flexible member operatively connecting said first and second rotational members respectively to said upper shaft and wherein said upper shaft is operatively connected to said resistance mechanism;

wherein said first and said second rotational members each include a lower pulley mounted for rotation with said lower shaft and further including a pair of upper pulleys mounted for rotation with said upper shaft, each associated with one of said lower pulleys, and wherein said first and second flexible members are engaged with said upper and lower pulleys; and a third flexible member connecting said upper shaft to said resistance mechanism.

* * * * *